US008702329B2

(12) United States Patent
Takabatake et al.

(10) Patent No.: US 8,702,329 B2
(45) Date of Patent: Apr. 22, 2014

(54) LABEL PRINTER

(75) Inventors: Yoshinari Takabatake, Shinagawa (JP); Yukihiro Mori, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 417 days.

(21) Appl. No.: 12/727,286

(22) Filed: Mar. 19, 2010

(65) Prior Publication Data

US 2010/0247219 A1 Sep. 30, 2010

(30) Foreign Application Priority Data

Mar. 24, 2009 (JP) ..... 2009-072696

(51) Int. Cl.
*B41J 15/00* (2006.01)

(52) U.S. Cl.
USPC ..... 400/611; 400/76; 400/621; 400/691

(58) Field of Classification Search
USPC ..... 399/108; 400/693.1, 691, 611, 76, 613, 400/621; 101/44
See application file for complete search history.

(56) References Cited

U.S. PATENT DOCUMENTS

| | | | | |
|---|---|---|---|---|
| 6,494,631 | B1 * | 12/2002 | Mastinick | 400/208 |
| 6,766,844 | B1 * | 7/2004 | Watkins | 156/760 |
| 7,121,313 | B2 * | 10/2006 | Ito | 156/767 |
| 7,284,922 | B2 * | 10/2007 | Takami et al. | 400/613 |
| 2006/0151118 | A1 * | 7/2006 | Murata et al. | 156/379 |

FOREIGN PATENT DOCUMENTS

| | | |
|---|---|---|
| JP | 08-300752 | 11/1996 |
| JP | 2005-213002 A | 8/2005 |
| JP | 2006-150867 A | 6/2006 |
| JP | 2007-083639 | 4/2007 |
| JP | 2008-114607 | 5/2008 |

* cited by examiner

*Primary Examiner* — Matthew G Marini
(74) *Attorney, Agent, or Firm* — IPUSA, PLLC

(57) ABSTRACT

A label printer for performing printing on a label temporarily adhered to a pasteboard of a sheet roll includes a main body on which a platen roller and a peeling bar are mounted, an installing part configured to have the sheet roll installed therein, an installing cover configured to close when the sheet roll is installed in the installing part, and a printing head and a peeling roller mounted to the installing cover. The peeling roller is configured to move along a groove formed in the installing cover and contact the platen roller when the installing cover is closed. The peeling bar is configured to peel the label from the pasteboard by bending the pasteboard after the pasteboard is wrapped around the peeling bar and is conveyed between the peeling roller and the platen roller.

13 Claims, 15 Drawing Sheets

LABEL PRINTER

BACKGROUND OF THE INVENTION

1. Field of the Invention

The present invention generally relates to a label printer.

2. Description of the Related Art

In fabricating a label by using a typical label printer, first, characters or the like are printed onto a label temporarily adhered to a pasteboard. Then, the label is peeled from the pasteboard by a label peeling mechanism so that the label and the pasteboard are discharged from separate paths of the label printer. In a label peeling mechanism according to a related art example, an apparatus peels a label from a pasteboard by conveying the pasteboard in a state bent 90 degrees or less and taking advantage of the out of plane stiffness of the label (see, for example, Japanese Laid-Open Patent Publication No. 2005-213002).

In a peeling mechanism according to another related art example, an apparatus can arbitrarily switch controls between printing onto a label without peeling the printed label from a pasteboard or printing onto a label and peeling the printed label from the pasteboard (see, for example, Japanese Laid-Open Patent Publication No. 2006-150867).

From an aspect of portable use of label printers and an aspect of cost reduction of label printers, label printers are desired to be light-weight and compact.

SUMMARY OF THE INVENTION

The present invention may provide a label printer that substantially eliminates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a label printer particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the invention provides a label printer for performing printing on a label temporarily adhered to a pasteboard of a sheet roll, the label printer including: a main body on which a platen roller and a peeling bar are mounted; an installing part configured to have the sheet roll installed therein; an installing cover configured to close when the sheet roll is installed in the installing part; and a printing head and a peeling roller mounted to the installing cover; wherein the peeling roller is configured to move along a groove formed in the installing cover and contact the platen roller when the installing cover is closed; wherein the peeling bar is configured to peel the label from the pasteboard by bending the pasteboard after the pasteboard is wrapped around the peeling bar and is conveyed between the peeling roller and the platen roller.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

First Embodiment

Figure 1:
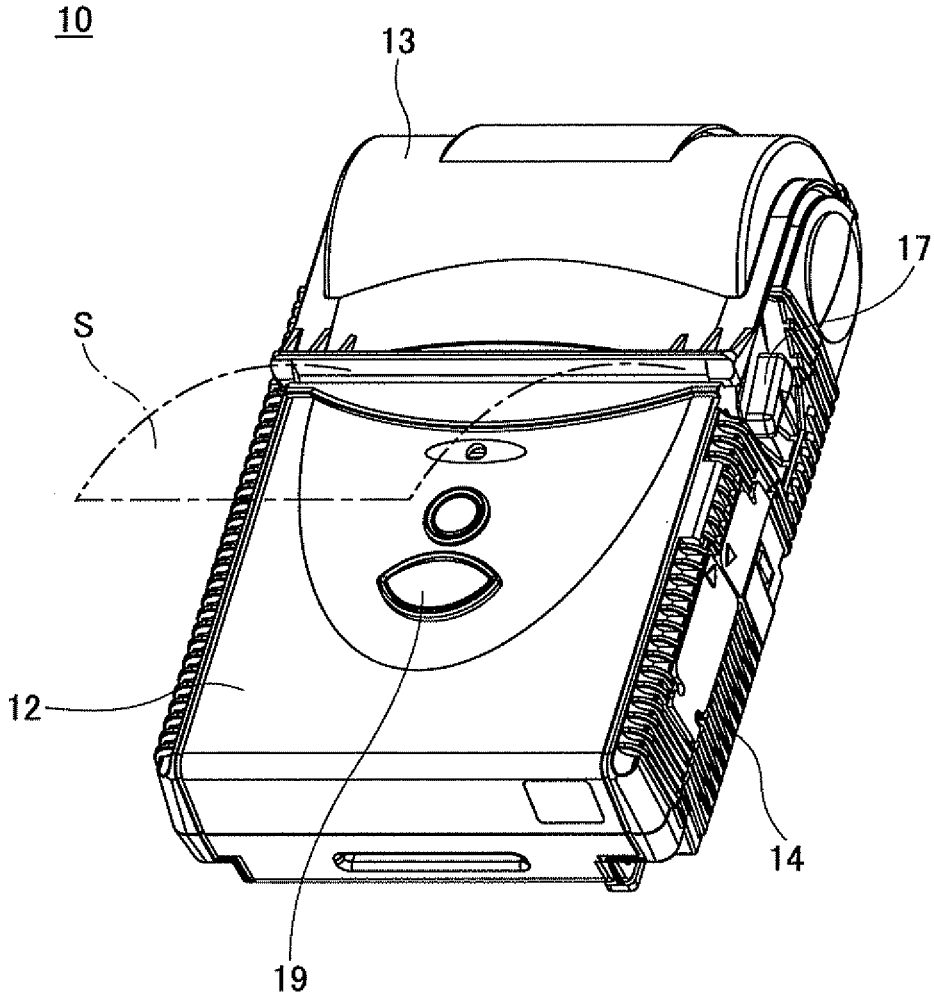
FIG. 1 is a first perspective view of a label printer according to an embodiment of the present invention in which a sheet roll installing cover and a battery installing cover of a label printer are illustrated in a closed state.
Figure 2:
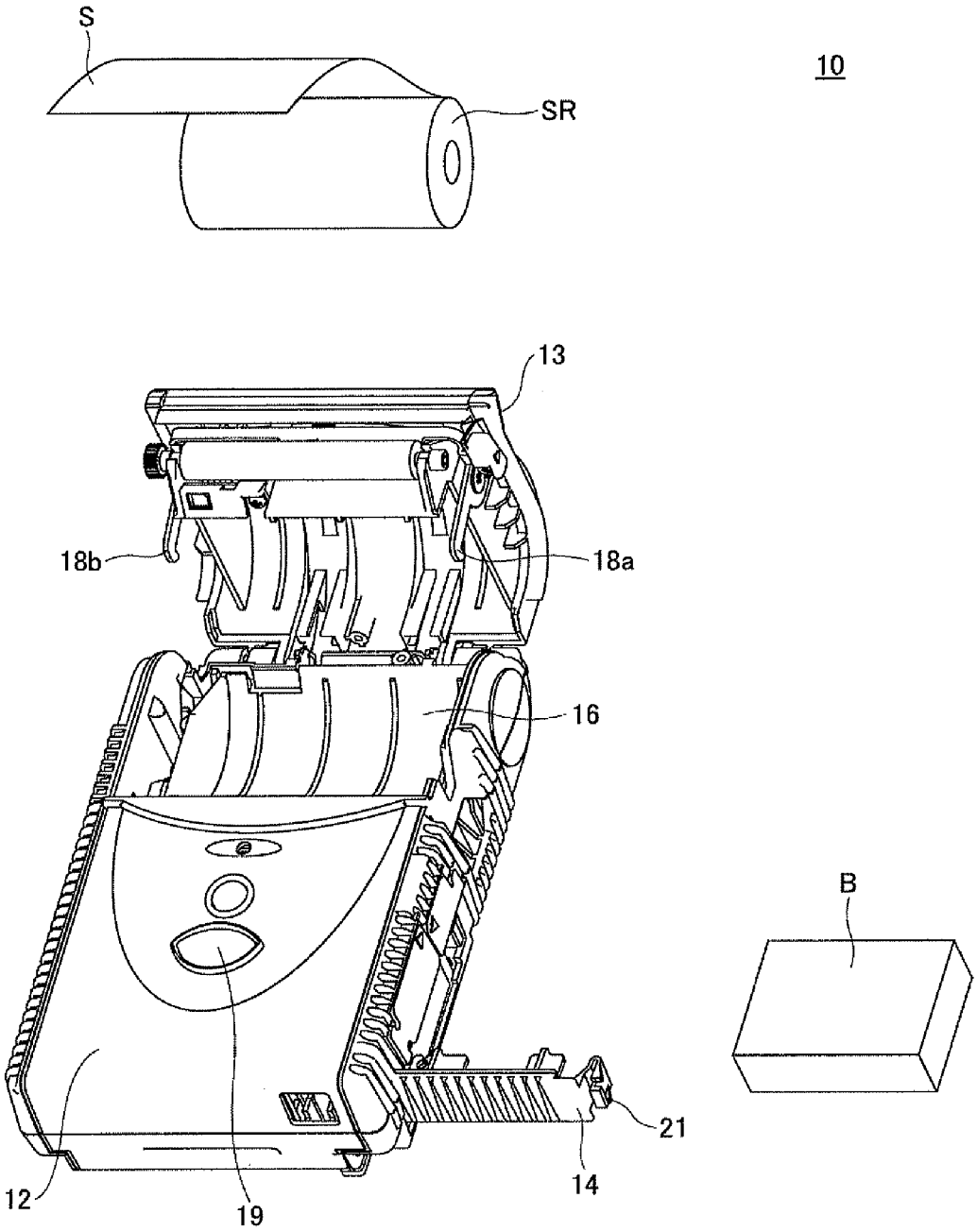
FIG. 2 is a second perspective view of a label printer according to an embodiment of the present invention in which a sheet roll installing cover and a battery installing cover are illustrated in an open state.

A label printer 10 according to a first embodiment of the present invention is described with reference to FIGS. 1 and 2. FIG. 1 is a first perspective view of the label printer 10 according to an embodiment of the present invention in which a sheet roll installing cover 13 and a battery installing cover 14 of the label printer 10 are illustrated in a closed state. FIG. 2 is a second perspective view of the label printer 10 according to an embodiment of the present invention in which the sheet roll installing cover 13 and the battery installing cover 14 are illustrated in an open state.

The label printer 10 according to an embodiment of the present invention has a substantially rectangular parallelepiped shape. The label printer 10 includes a main body 12, the sheet roll installing cover 13, and the battery installing cover 14. The sheet roll installing cover 13 is a part of an upper surface portion of the label printer 10 according to an embodiment of the present invention. After a sheet roll SR is placed inside a sheet roll installing part 16, the sheet roll SR can be installed by closing the sheet roll installing cover 13. The sheet roll installing cover 13 has a control knob 17. By sliding the control knob 17, lock levers 18*a* and 18*b* can be moved to allow the sheet roll installing cover 13 to open and separate from the main body 12. An operation button 19 is provided on a surface of the main body 12. The operation button 19 is for performing an operation of, for example, printing (outputting) a label.

The battery installing cover 14 is provided at a side portion of the main body 12. A battery B can be installed by placing the battery B into a battery installing part 20 and closing the battery installing cover 14. By operating the control knob 21, the battery installing cover 14 can be opened and closed. The sheet roll SR is shaped as a roll. The sheet S includes a label R temporarily adhered to a surface of a pasteboard P having a belt-like shape.

Figure 3:
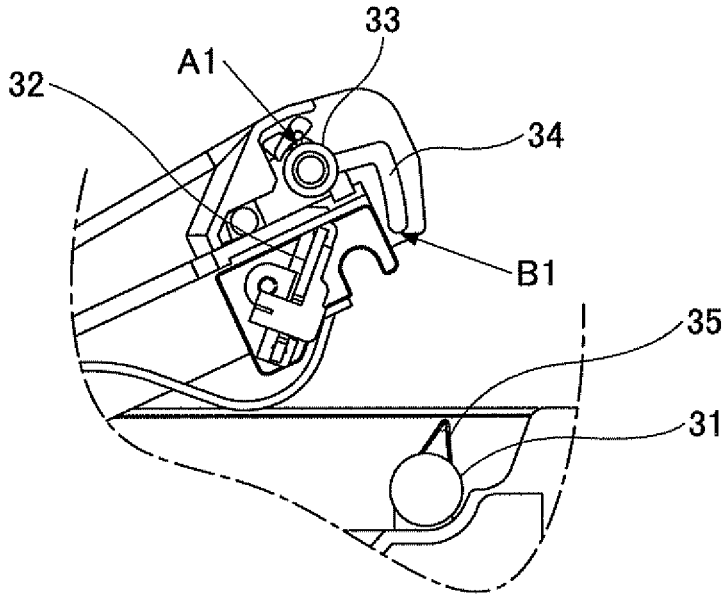
FIG. 3 is a schematic diagram illustrating a portion of the label printer according to an embodiment of the present invention in a state where a sheet roll installing cover is open.
Figure 4:
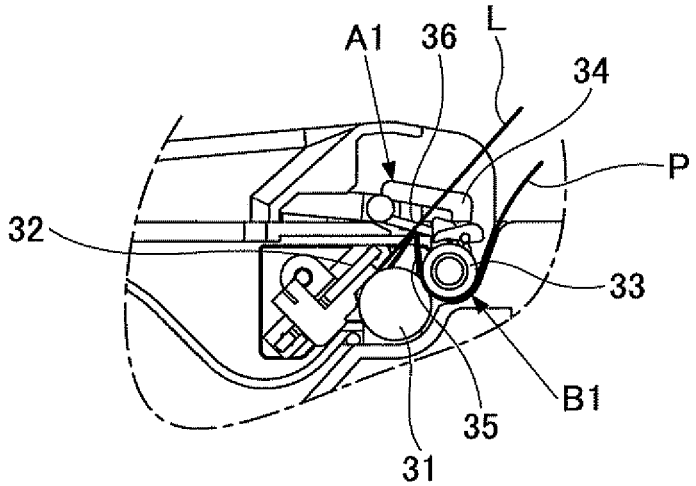
FIG. 4 is a schematic diagram illustrating a portion of a label printer according to an embodiment of the present invention in a state where a sheet roll installing cover is closed.
Figure 5:
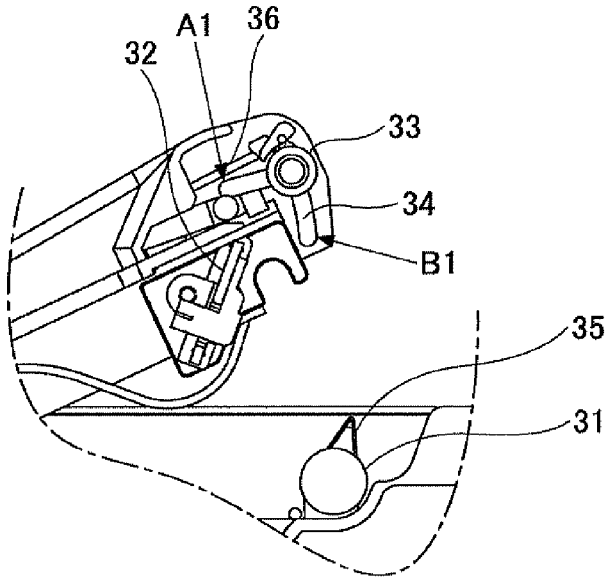
FIG. 5 is a schematic diagram illustrating a portion of a label printer according to an embodiment of the present invention in a state where a sheet roll installing cover is in the middle of shifting from the open state of FIG. 3 to the closed state of FIG. 4.
Figure 6:
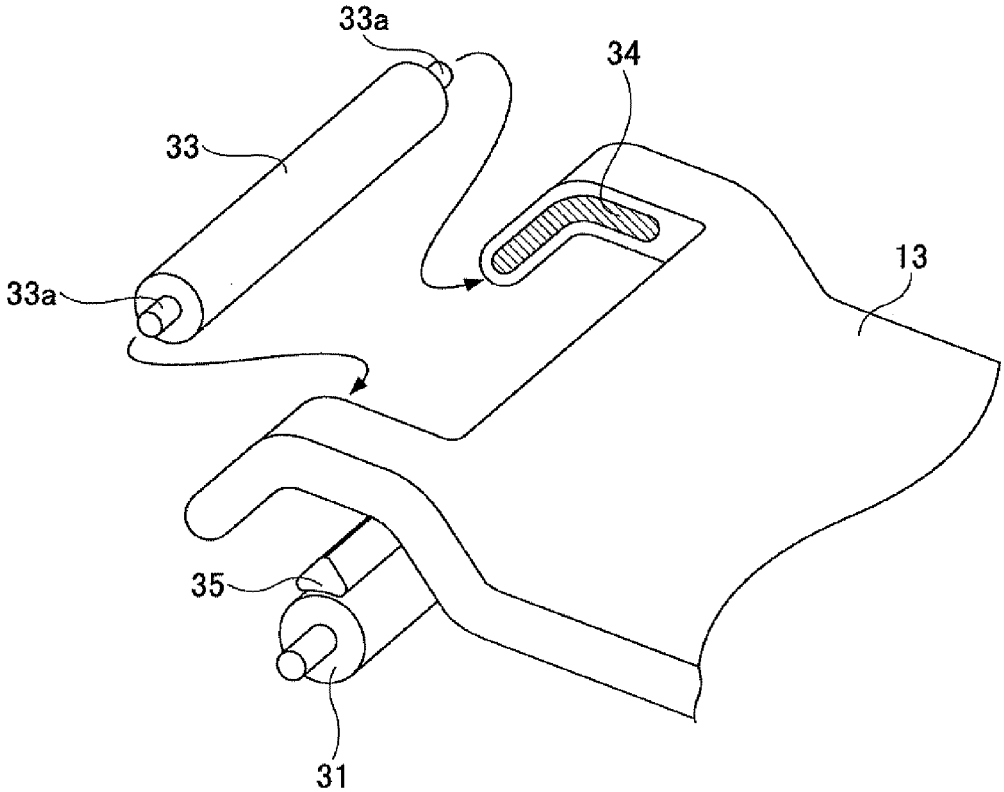
FIG. 6 is a schematic diagram illustrating a schematic diagram of the sheet roll installing cover according to an embodiment of the present invention.

FIG. 3 illustrates a portion of the label printer 10 according to an embodiment of the present invention in a state where the sheet roll installing cover 13 is open. FIG. 4 illustrates a portion of the label printer 10 according to an embodiment of the present invention in a state where the sheet roll installing cover 13 is closed. FIG. 5 illustrates a portion of the label printer 10 according to an embodiment of the present invention in state where the sheet roll installing cover 13 is in the middle of shifting from the open state of FIG. 3 to the closed state of FIG. 4. FIG. 6 illustrates a schematic diagram of the sheet roll installing cover 13 according to an embodiment of the present invention.

The label printer 10 according to an embodiment of the present invention includes a platen roller 31 that is mounted on the main body 12. A printing head 32 and a peeling roller 33 are installed on the sheet roll installing cover 13. The peeling roller 33 is movably mounted on the sheet roll installing cover 13 in which a shaft 33*a* of the peeling roller 33 can travel along a groove 34 formed in the sheet roll installing cover 13. A peeling bar 35 is provided in the vicinity of the platen roller 31. For example, the peeling bar 35 may be mounted on the platen roller 31 directly or via an attachment part (not illustrated). Alternatively, the peeling bar 35 may be mounted on the sheet roll installing cover 13 directly or via an attachment part (not illustrated).

When the sheet roll installing cover 13 is in an open state, the peeling roller 33 is positioned at one end of the groove 34 (position A1). In a case of closing the sheet roll installing cover 13, the peeling roller 33 contacts a part of the main body 12 and moves along the groove 34 until the peeling roller 33 reaches the other end of the groove 34 (position B1). A spring 36 applies a force on the peeling roller 33. In a case of opening the sheet roll installing cover 13, the peeling roller 33 moves along the groove 34 from the position B1 to the position A1.

In other words, in a case of closing the paper roll installing cover 13 provided with the peeling roller 33, a tip of the spring 36 contacts a protrusion having an inclined plane (not illustrated) of the main body 12 to allow the peeling roller 33 to slide to the other end of the groove 34. By the closing of the paper roll installing cover 13, the tip of the spring 36 is pressed by the main body 12 to cause the peeling roller 33 to move to a position that contacts the platen roller 31. Thereby, the platen roller 31 and the peeling roller 33 are pressed against each other to provide a ready-to-peel state.

It is to be noted that the spring 36 may be omitted from the configuration of the label printer 10 so that the number of components can be reduced and to reduce manufacturing cost.

In a state where the sheet roll installing cover 13 is closed, the sheet S, which is installed in the sheet roll installing part 16, is conveyed between the printing head 32 and the platen roller 31. Characters or the like are printed onto the sheet S when the sheet S is conveyed between the printing head 32 and the platen roller 31. After characters or the like are printed onto the sheet S, the sheet S wraps around the triangular column-like peeling bar 35 provided in the vicinity of the platen roller 31. The sheet S is bent in an angle of 90 degrees or less so that the label L can be peeled from the pasteboard P.

Figure 7:
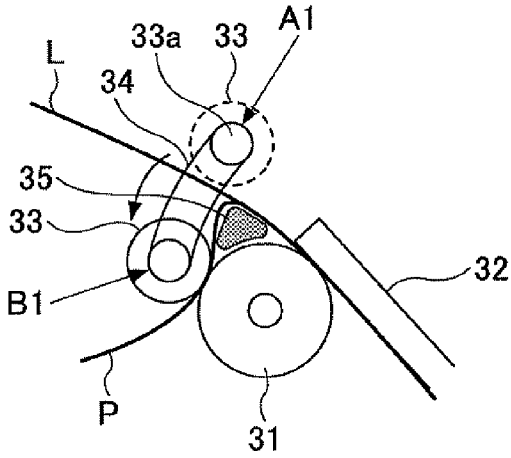
FIG. 7 is a schematic diagram illustrating an embodiment of a groove having a shape different from the embodiment illustrated in FIG. 3.

FIG. 7 illustrates an embodiment of the groove 34 having a shape different from the above-described embodiment illustrated in, for example, FIG. 3. By forming the groove 34 having a more moderate shape, the shaft 33*a* of the peeling roller 33 can move between the position A1 and the position B1 more smoothly. Thereby, the peeling roller 33 can move along the groove 34 more smoothly.

In a case where the label L is not intended to be peeled from the pasteboard P, a mechanism (not illustrated) may control the movement of the peeling roller 33 for preventing the peeling roller 33 from moving between the position A1 and the position B1 even in a case of closing the sheet roll installing cover 13. In this case, the label L will not peel from the pasteboard P because the sheet S is prevented from bending in an angle of 90 degrees or less. Thus, the sheet S can be discharged in a state having characters or the like printed on the label L being temporarily adhered to the pasteboard D.

Second Embodiment

The label printer 10 according to a second embodiment of the present invention is described with reference to FIGS.

Figure 8:
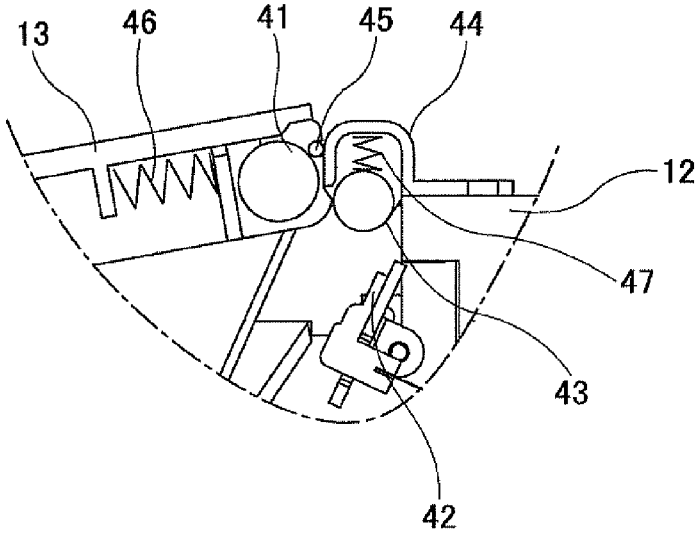
FIG. 8 is a schematic diagram illustrating a portion of a label printer according to the second embodiment of the present invention in a state where a sheet roll installing cover is open.
Figure 9:
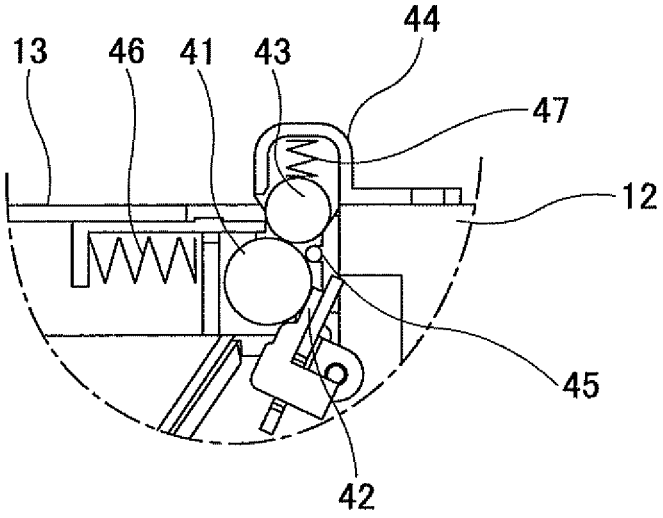
FIG. 9 is a schematic diagram illustrating a portion of a label printer according to the second embodiment of the present invention in a state where a sheet roll installing cover is closed.
Figure 10:
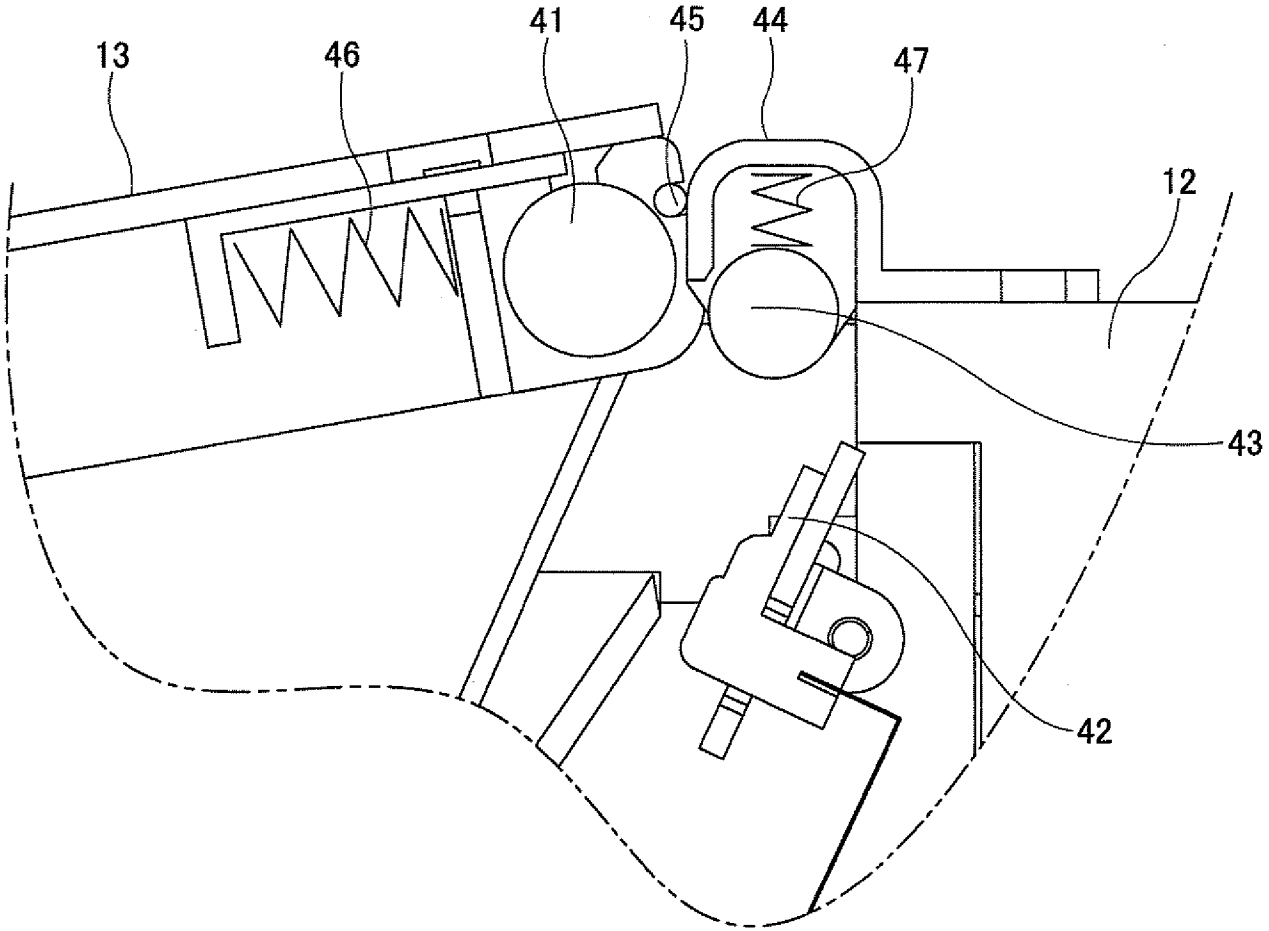
FIG. 10 is an enlarged view of a peeling roller of FIG. 8.

8-10. In the description and drawings of the second embodiment, like components are denoted by like reference numerals as those of the first embodiment and are not further explained. FIG. 8 illustrates a portion of the label printer 10 according to the second embodiment of the present invention in a state where the sheet roll installing cover 13 is open. FIG. 9 illustrates a portion of the label printer 10 according to the second embodiment of the present invention in a state where the sheet roll installing cover 13 is closed. FIG. 10 is an enlarged view of a peeling roller 43 of FIG. 8.

In the second embodiment, a platen roller 41 and a peeling bar 45 are mounted on the sheet roll installing cover 13. Further, a printing head 42 is positioned at an inner side of a main body 12. When the sheet roll installing cover 13 is closed, a peeling roller 43 is positioned at an outer side of a main body 12 in a state where the sheet roll installing cover 13 contacts the peeling roller 43.

In this embodiment, a peeling roller cover 44 is mounted on the main body 12 in a manner covering the outside of the peeling roller 43. When the sheet roll installing cover 13 is closed, the platen roller 41 is pressed toward the inside of the sheet roll installing cover 13. A spring 46 is provided attached to the sheet roll installing cover 13. The spring 46 presses the platen roller 41 in an outward direction. In a state where the sheet roll installing cover 13 is closed, the pressing of the spring 46 causes the platen roller 41 to contact the printing head 42. A spring 47 is provided attached to the peeling roller cover 44. The spring 47 applies a force in a downward direction to the peeling roller 43. In a state where the sheet roll installing cover 13 is closed, the downward force of the spring 46 causes the peeling roller 43 to contact the platen roller 41.

After characters or the like are printed onto the sheet S when the sheet S is conveyed between the printing head 42 and the platen roller 41, the sheet S wraps around the peeling bar 45 provided in the vicinity of the platen roller 41 and is conveyed between the platen roller 41 and the peeling roller 43. Then, the sheet S is bent in an angle of 90 degrees or less so that the label L can be peeled from the pasteboard P. Then, the sheet S is discharged from the label printer 10.

Third Embodiment

Figure 12:
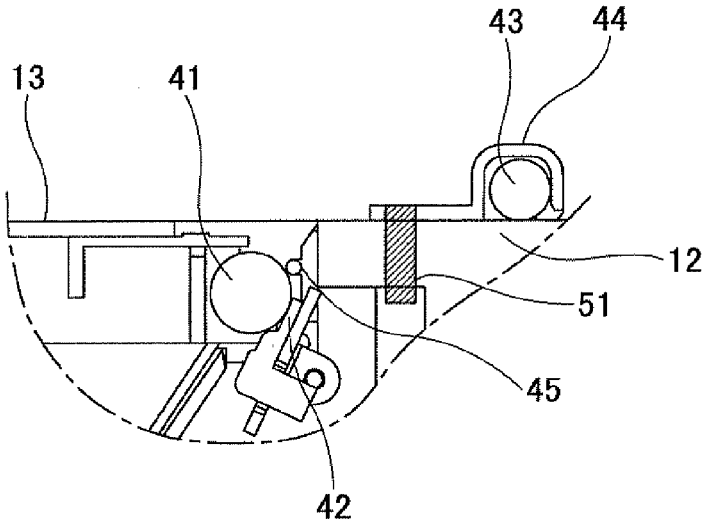
FIG. 12 is a schematic diagram illustrating a portion of a label printer according to the third embodiment of the present invention in a position for not peeling a label L from a pasteboard P.
Figure 13:
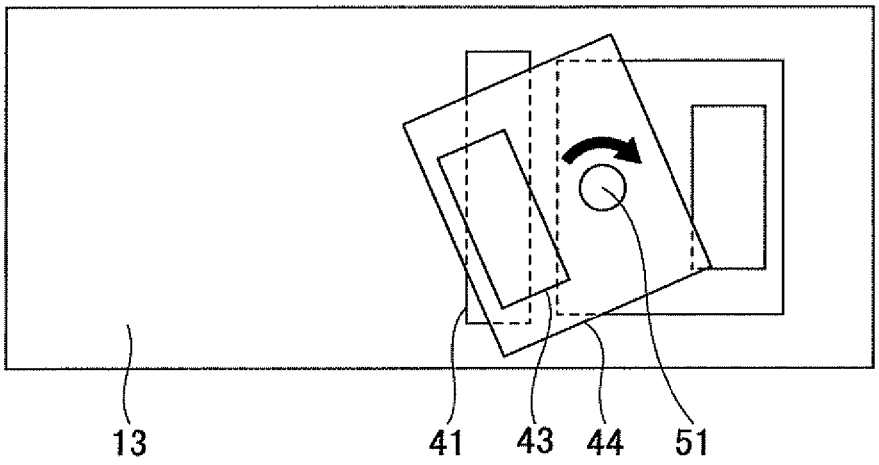
FIG. 13 is a schematic diagram illustrating a configuration where a peeling roller and a peeling roller cover can rotate around a rotational shaft serving as the center of the rotation.

The label printer 10 according to a third embodiment of the present invention is described with reference to FIGS. 11-13. The label printer 10 according to the third embodiment has a mechanism of preventing the label L from being peeled from the pasteboard P. In the description and drawings of the third embodiment, like components are denoted by like reference numerals as those of the first and second embodiments and are not further explained.

Figure 11:
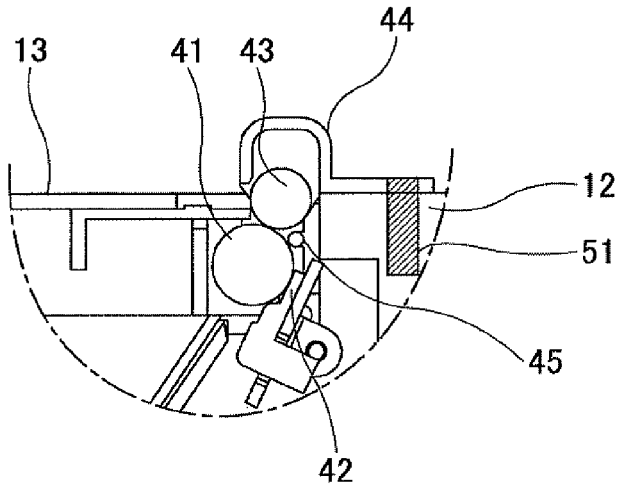
FIG. 11 is a schematic diagram illustrating a portion of a label printer according to the third embodiment of the present invention in a position for peeling a label L from a pasteboard P.

FIG. 11 illustrates a portion of the label printer 10 according to the third embodiment of the present invention in a position for peeling the label L from the pasteboard P. FIG. 12 illustrates a portion of the label printer 10 according to the third embodiment of the present invention in a position for not peeling the label L from the pasteboard P. FIG. 13 is a schematic diagram illustrating a configuration where the peeling roller 43 and the peeling roller cover 44 can rotate around a rotational shaft 51 serving as the center of the rotation. In this example, the rotational shaft 51 is mounted on the peeling roller cover 44 in a perpendicularly intersecting manner with respect to the main body 12. In a case of peeling the label L from the pasteboard P, the peeling roller cover 44 is rotated to a position in which the peeling roller 43 contacts the platen roller 41. In the same manner described in the second embodiment, by positioning the peeling roller 43 to contact the platen roller 41, the label L can be peeled from the pasteboard P. Then, the sheet S is discharged from the label printer 10. In a case of not peeling the label L from the pasteboard P, the peeling roller cover 44 is rotated to a position in which the peeling roller 43 is positioned at an opposite side from the platen roller 41. Because the peeling roller 43 does not contact the platen roller 41, the sheet S having the label L temporarily adhered to the pasteboard P can have characters or the like printed thereon by the printing head 42 and be discharged while maintaining the state of having the label L temporarily adhered to the pasteboard P.

In printing characters or the like on the label L according to the third embodiment, a state (position) for peeling the label L from the pasteboard P and a state (position) for not peeling the label from the pasteboard P can be selected.

Fourth Embodiment

Figure 14:
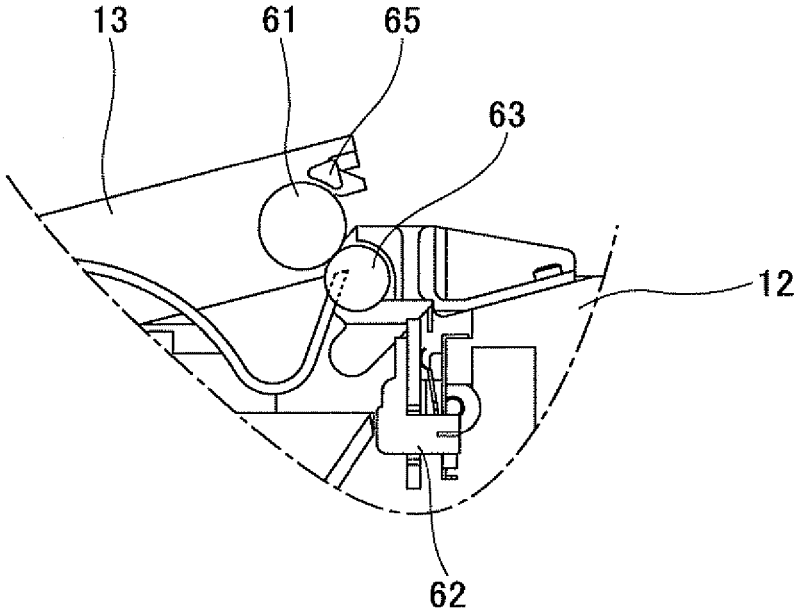
FIG. 14 is a schematic diagram illustrating a portion of a label printer according to the fourth embodiment of the present invention in a state where a sheet roll installing cover is open.
Figure 15:
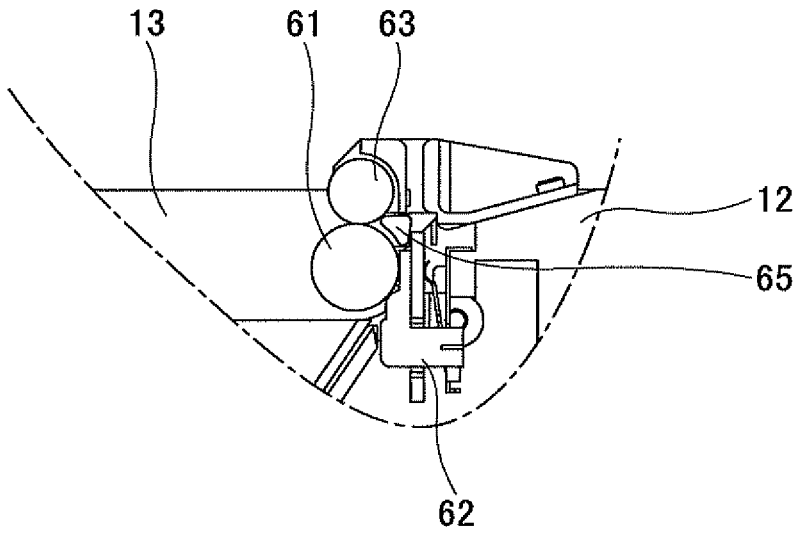
FIG. 15 is a schematic diagram illustrating a portion of a label printer according to the fourth embodiment of the present invention in a state where a sheet roll installing cover is closed.
Figure 16:
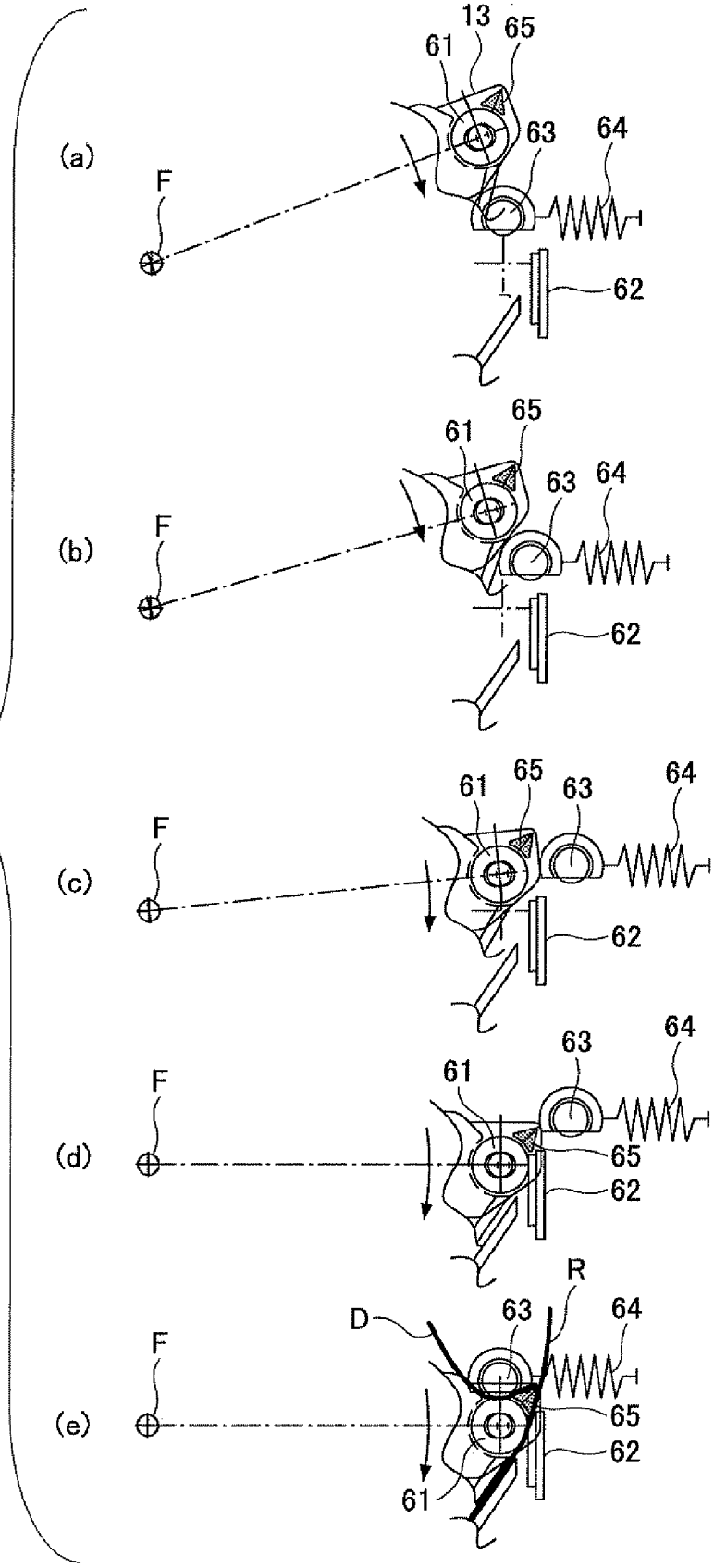
FIG. 16 is a schematic diagram illustrating a sheet roll installing cover shifting from an open state to a closed state in a step by step manner.

The label printer 10 according to a fourth embodiment of the present invention is described with reference to FIGS. 14-16. In the description and drawings of the fourth embodiment, like components are denoted by like reference numerals as those of the first, second and third embodiments and are not further explained. FIG. 14 illustrates a portion of the label printer 10 according to the fourth embodiment of the present invention in a state where the sheet roll installing cover 13 is open. FIG. 15 illustrates a portion of the label printer 10 according to the fourth embodiment of the present invention in a state where the sheet roll installing cover 13 is closed. FIG. 16 is a schematic diagram illustrating the sheet roll installing cover 13 shifting from an open state to a closed state in a step-by-step manner. In FIG. 16, the letter "F" indicates a fulcrum of the sheet roll installing cover 13.

In the label printer 10 according to the fourth embodiment, a platen roller 61 is mounted on the paper roll installing cover 13. A printing head 62 and a peeling roller 63 are mounted on the main body 12. A spring 64 is attached to the main body 12 for applying a force to the peeling roller in a leftward direction. A peeling bar 65 is provided in the vicinity of the platen roller 61 of the paper roll installing cover 13.

In (a) of FIG. 16, the paper roll installing cover 13 in an open state is illustrated.

In (b) of FIG. 16, the peeling roller 63 being pressed by the sheet roll installing cover 13 and moved in a rightward direction in FIG. 16 is illustrated.

In (c) of FIG. 16, the peeling roller 63 in a rightmost position is illustrated. Then, via the state illustrated in (d) of FIG. 16, the peeling roller 63 returns to its initial position by being pressed by the spring 64 as illustrated in (e) of FIG. 16. As illustrated in (e) of FIG. 16, the peeling roller 63 is moved to a position above the platen roller 61 and in contact with the platen roller 61. The peeling roller 63 is moved to the position above the platen roller 61 by the force applied by the spring 64.

After characters or the like are printed on the sheet S when the sheet is conveyed between the printing head 62 and the platen roller 61, the sheet S wraps around the peeling bar 65 and passes between the platen roller 61 and the peeling roller 63. Then, the sheet S is bent in an angle of 90 degrees or less so that the label L can be peeled from the pasteboard P.

Fifth Embodiment

The label printer 10 according to a fifth embodiment of the present invention is described with reference to FIGS. 17-20. In the description and drawings of the fifth embodiment, like components are denoted by like reference numerals as those of the first, second, third, and fourth embodiments and are not further explained.

Figure 17:
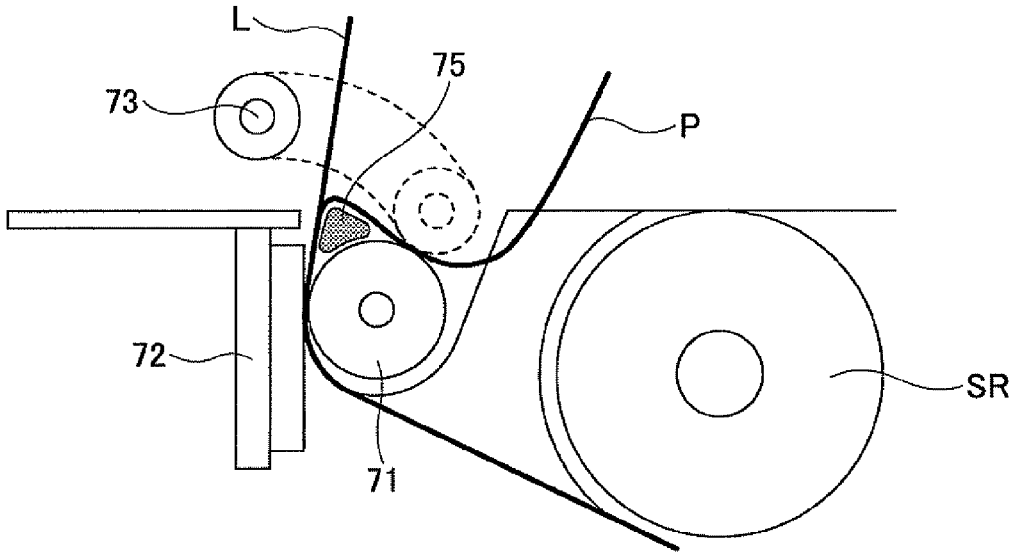
FIG. 17 is a schematic diagram illustrating a portion of a label printer according to the fifth embodiment of the present invention in a state where a sheet roll installing cover is open.
Figure 18:
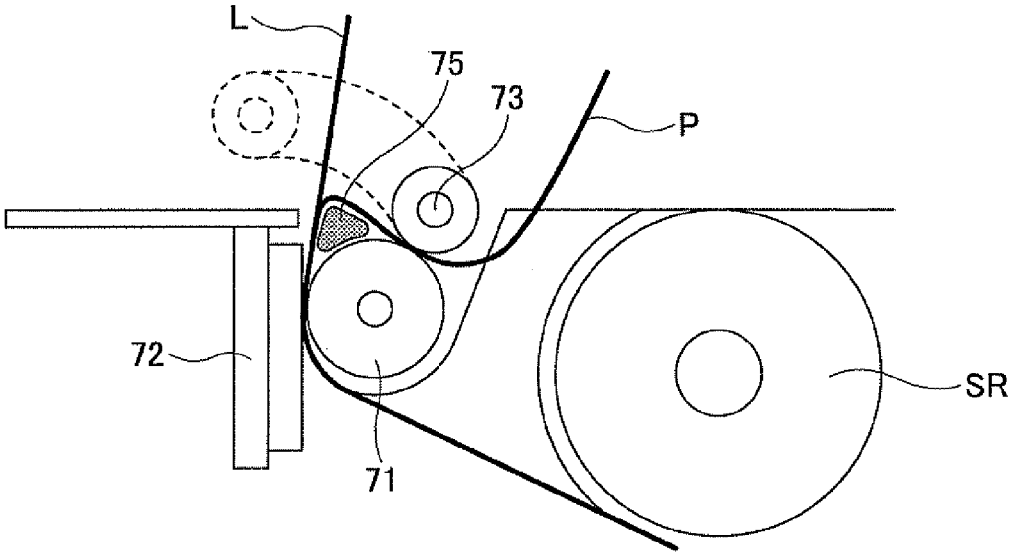
FIG. 18 is a schematic diagram illustrating a portion of a label printer according to the fifth embodiment of the present invention in a state where a sheet roll installing cover is closed.
Figure 19:
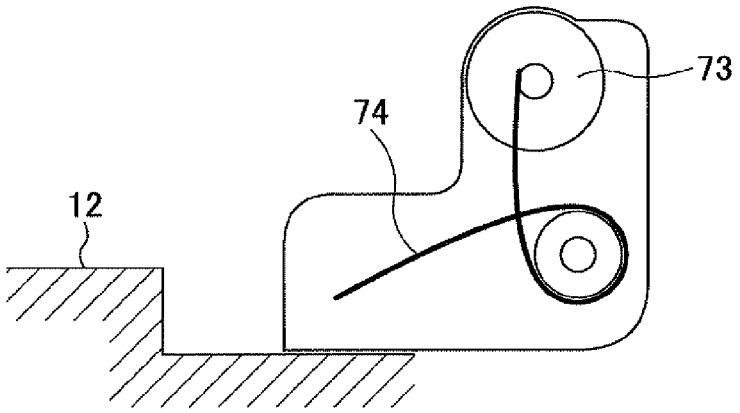
FIG. 19 is a schematic diagram illustrating the vicinity of a peeling roller in a state where a sheet roll installing cover is open according to an embodiment of the present invention.
Figure 20:
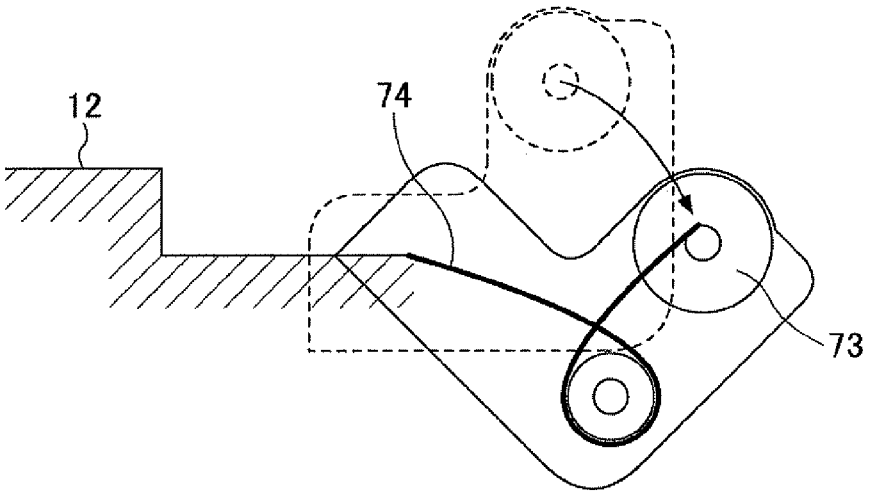
FIG. 20 is schematic diagram illustrating the vicinity of the peeling roller in a state where a sheet roll installing cover is closed according to an embodiment of the present invention.
Figure 21:
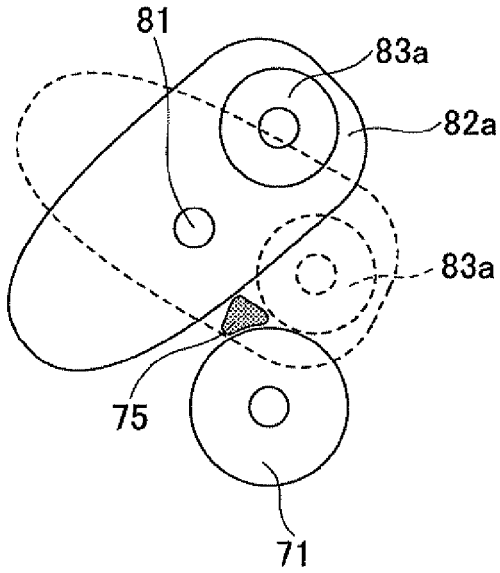
FIG. 21 is a schematic diagram illustrating a modified example of a peeling roller according to an embodiment of the present invention.

FIG. 17 illustrates a portion of the label printer 10 according to the fifth embodiment of the present invention in a state where the sheet roll installing cover 13 is open. FIG. 18 illustrates a portion of the label printer 10 according to the fifth embodiment of the present invention in a state where the sheet roll installing cover 13 is closed. FIG. 19 is a schematic diagram illustrating the vicinity of a peeling roller 73 in a state where the sheet roll installing cover 13 is open. FIG. 20 is schematic diagram illustrating the vicinity of the peeling roller 73 in a state where the sheet roll installing cover 13 is closed.

In the label printer 10 according to the fifth embodiment, a printing head 72 is mounted on the main body 12. A platen roller 71 and the peeling roller 73 are attached to the sheet roll installing cover 13. As illustrated in FIGS. 19 and 20, the peeling roller 73 is connected to one end of a wire spring 74. When the sheet roll installing cover 13 is closed, the other end of the wire spring 74 contacts a part of the main body 12. This contact generates a force that causes the peeling roller 73 to move in a direction indicated with an arrow in FIG. 20.

After characters or the like are printed on the sheet S when the sheet is conveyed between the printing head 72 and the platen roller 71, the sheet S wraps around a peeling bar 75 and passes between the platen roller 71 and the peeling roller 73. Then, the sheet S is bent in an angle of 90 degrees or less so that the label L can be peeled from the pasteboard P.

It is to be noted that, in a case of not peeling the label L from the pasteboard P or a case of printing on the sheet S where the sheet S is plain paper, the sheet S is discharged from the label printer 10 without wrapping around the peeling bar 75 after characters or the like are printed on the sheet S between the printing head 72 and the platen roller 71.

Figure 22:
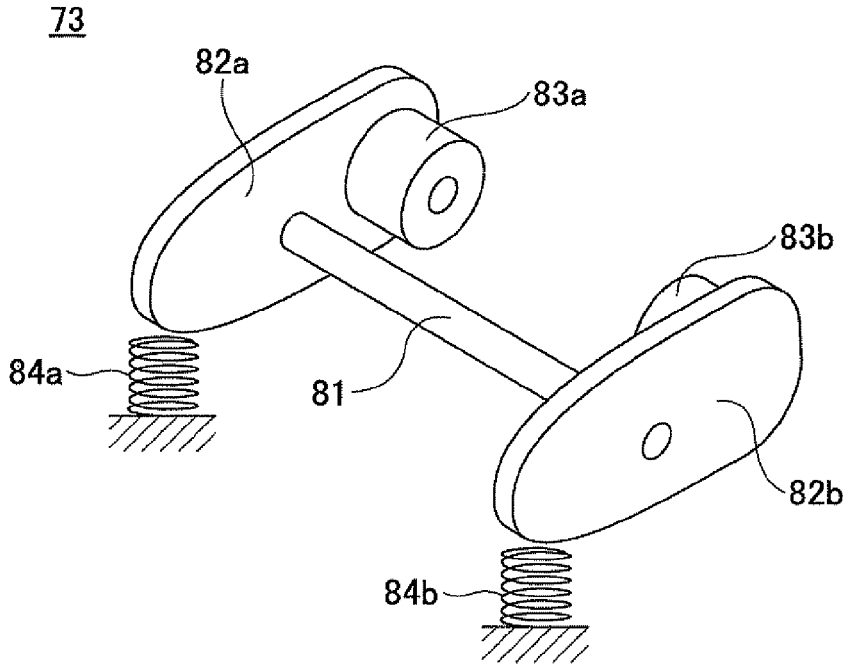
FIG. 22 is a perspective view illustrating a modified example of a peeling roller according to an embodiment of the present invention.

According to a modified example, other than having a circular cylindrical rod-like shape, the peeling roller 73 may be configured having a rotational shaft 81, two link plates 82*a* and 82*b* connected via the rotational shaft 81, and two separate peeling roller parts 83*a*, 83*b* connected to corresponding link plates 82*a*, 82*b* corresponding to both ends of a sheet S (sheet S not illustrated) as shown in FIG. 22. This is because the same effects as the above-described embodiments can be attained with the peeling roller 73 having separate peeling roller parts 83*a*, 83*b*. In this modified example, springs 84*a* and 84*b* apply forces to corresponding link parts 82*a* and 82*b*. With the configuration of this modified example, the material cost and weight of the label printer 10 can be reduced compared to the peeling roller 73 having a circular cylindrical rod-like shape.

Figure 23:
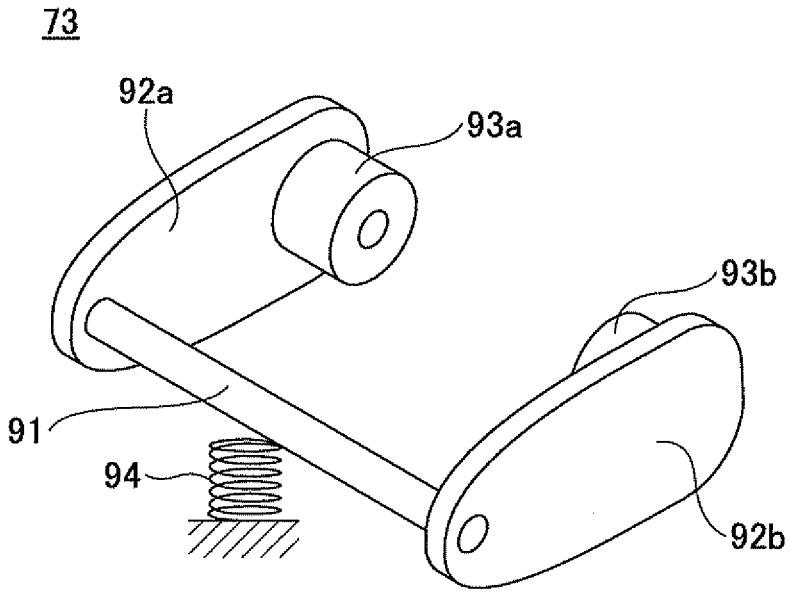
FIG. 23 is a perspective view illustrating another modified example of a peeling roller according to an embodiment of the present invention.

FIG. 23 illustrates another modified example in which a single spring 94 is used unlike the configuration of FIG. 22 using two springs 84*a* and 84*b*. In this other modified example, link parts 92*a* and 92*b* are mounted on a rotational shaft 91. Corresponding separate peeling roller parts 93*a* and 93*b* are attached to the inner side wall of the link plates 92*a* and 92*b*. The spring 94 applies a force directly to the rotational shaft 91. With the configuration of the modified example, the number of springs 94 could be reduced to one. Thereby, the manufacture cost and the weight of the label printer 10 can be reduced.

Further, the present invention is not limited to these embodiments, but variations and modifications may be made without departing from the scope of the present invention.

The present application is based on Japanese Priority Application No. 2009-072696 filed on Mar. 24, 2009, with the Japanese Patent Office, the entire contents of which are hereby incorporated by reference.

What is claimed is:

1. A label printer for performing printing on a label temporarily adhered to a sheet of a sheet roll, the label printer comprising:

a main body on which a platen roller and a peeling bar are mounted;

an installing part configured to have the sheet roll installed therein;

an installing cover configured to close in a manner covering the installing part; and a printing head and a peeling roller mounted to the installing cover;

wherein the peeling roller is configured to move along a groove formed in the installing cover and contact the platen roller when the installing cover is closed;

wherein the sheet is conveyed between the peeling roller and the platen roller after the sheet is wrapped around the peeling bar;

wherein the peeling bar is configured to bend the sheet wrapped around the peeling bar;

wherein the label is peeled from the sheet wrapped around the peeling bar by bending the sheet with the peeling bar;

wherein the groove includes first and second ends; and wherein the peeling roller is configured to move between the first and the second ends in correspondence with opening and closing of the installing cover.

2. The label printer as claimed in claim 1, further comprising:

a spring mounted on the installing cover;

wherein the spring is configured to move the peeling roller along the groove by applying a force to the peeling roller.

3. The label printer as claimed in claim 1, wherein the peeling roller is configured to move along the groove in a case where the installing cover is in an open state.

4. The label printer as claimed in claim 1, wherein the peeling roller is configured to move to the first end in a case of peeling the label from the sheet and move to the second end in a case of preventing the label from being peeled from the sheet.

5. The label printer as claimed in claim 1, wherein the peeling roller is configured to move to the first end in a case of bending the sheet to a predetermined angle and move to the second end in a case of preventing the sheet from bending to the predetermined angle.

6. The label printer as claimed in claim 1, wherein the sheet includes a pasteboard having the label temporarily adhered thereto.

7. A label printer for performing printing on a label temporarily adhered to a sheet of a sheet roll, the label printer comprising:

a main body on which a printing head, a peeling roller, and a first spring are mounted;

an installing part configured to have the sheet roll installed therein;

an installing cover configured to close in a manner covering the installing part; and a platen roller, a peeling bar, and a second spring mounted on the installing cover;

wherein the first spring is configured to press the peeling roller toward the platen roller in a case where the installing cover is closed;

wherein the second spring is configured to press the platen roller toward the printing head in a case where the installing cover is closed;

wherein the sheet is conveyed between the peeling roller and the platen roller after the sheet is wrapped around the peeling bar;

wherein the peeling bar is configured to bend the sheet wrapped around the peeling bar;

wherein the label is peeled from the sheet wrapped around the peeling bar by bending the sheet with the peeling bar.

8. The label printer as claimed in claim 7, wherein the peeling roller is positioned more toward the outside of the label printer than the platen roller in a case where the installing cover is closed.

9. The label printer as claimed in claim 7, further comprising:

a rotational shaft mounted on the installing cover in a manner perpendicularly intersecting the main body;

wherein the rotational shaft is configured to rotate the installing cover to a position in which the peeling roller and the platen roller contact each other in a case of peeling the label from the sheet; and wherein the rotational shaft is configured to rotate the installing cover to a position in which the peeling roller and the platen roller are positioned opposite from each other.

10. The label printer as claimed in claim 7, wherein the sheet is a pasteboard having the label temporarily adhered thereto.

11. A label printer for performing printing on a label temporarily adhered to a sheet of a sheet roll, the label printer comprising:

a main body on which a printing head is mounted;

an installing part configured to have the sheet roll installed therein;

an installing cover configured to close in a manner covering the installing part; and a platen roller, a peeling bar, a peeling roller, and a spring mounted on the installing cover;

wherein the spring is configured to press the peeling roller to the platen roller in a case where the installing cover is closed;

wherein the sheet is conveyed between the peeling roller and the platen roller after the sheet is wrapped around the peeling bar;

wherein the peeling bar is configured to bend the sheet wrapped around the peeling bar;

wherein the label is peeled from the sheet wrapped around the peeling bar by bending the sheet with the peeling bar;

wherein the spring includes one end connected to the peeling roller and another end that contacts the main body in the case where the installing cover is closed; and wherein the installing cover is configured to move the peeling roller toward the platen roller by way of a force generated by the contact between the other end of the spring and the main body in the case where the installing cover is closed.

12. The label printer as claimed in claim 11, wherein the peeling roller includes a rotational shaft, two link plates connected by the rotational shaft, and two roller parts connecting to the two link plates, respectively, wherein in a case where the installing cover is closed, the peeling roller is configured to rotate around the rotational shaft so that the two roller parts contact the platen roller.

13. The label printer as claimed in claim 11, wherein the sheet is a pasteboard having the label temporarily adhered thereto.

* * * * *